US008234903B2

(12) United States Patent
Claasen

(10) Patent No.: US 8,234,903 B2
(45) Date of Patent: Aug. 7, 2012

(54) MANIPULATOR FOR FORGING MACHINE

(75) Inventor: Karl Hermann Claasen, Moers (DE)

(73) Assignee: SMS MEER GmbH, Moenchengladbach (DE)

( * ) Notice: Subject to any disclaimer, the term of this patent is extended or adjusted under 35 U.S.C. 154(b) by 207 days.

(21) Appl. No.: 12/764,201

(22) Filed: Apr. 21, 2010

(65) Prior Publication Data

US 2010/0269562 A1 Oct. 28, 2010

(30) Foreign Application Priority Data

Apr. 23, 2009 (DE) ..... 102009018353
Nov. 6, 2009 (DE) ..... 102009052141

(51) Int. Cl.
*B21D 43/10* (2006.01)

(52) U.S. Cl. ..... 72/361; 72/422

(58) Field of Classification Search ..... 72/293, 72/298, 295, 301, 306, 311, 419, 421, 422, 72/361, 420, 270, 257; 29/281.1; 269/32; 414/745.1, 783; 294/82.1, 86.4, 192, 198
See application file for complete search history.

(56) References Cited

U.S. PATENT DOCUMENTS 3,036,854 A * 5/1962 Zimmermann et al. ..... 294/198
3,759,563 A * 9/1973 Kitamura ..... 294/198
4,098,320 A * 7/1978 Kinkopf ..... 164/407
4,776,199 A * 10/1988 Schubert ..... 72/422
4,848,373 A * 7/1989 Lenkey ..... 131/297
4,878,373 A * 11/1989 Wilson et al. ..... 72/422
5,000,028 A * 3/1991 Krieger ..... 72/421
5,218,855 A * 6/1993 Werner et al. ..... 72/420
5,355,743 A * 10/1994 Tesar ..... 74/490.03

FOREIGN PATENT DOCUMENTS

EP 434891 B 7/1991

* cited by examiner

*Primary Examiner* — Edward Tolan
*Assistant Examiner* — Pradeep C Battula
(74) *Attorney, Agent, or Firm* — Andrew Wilford

(57) ABSTRACT

A forging press has a workpiece manipulator having a shaft centered on and rotatable about an axis, a grab for holding the workpiece in the press and rotationally fixed to the shaft carrying the grab and centered on and rotatable about an axis, and a disk fixed angularly to the shaft and projecting radially outward therefrom. Two couplings are juxtaposed with the disk, rotatable relative to the shaft about, and have respective clutches for locking onto the disk so that when locked onto the disk the couplings are rotationally fixed to the disk. Respective actuators connected to the actuators can angularly shift the disk and thereby rotate the shaft, the grab, and the workpiece held by the grab.

11 Claims, 6 Drawing Sheets

MANIPULATOR FOR FORGING MACHINE

FIELD OF THE INVENTION

The present invention relates to a forging machine. More particularly this invention concerns manipulator for a forging machine.

BACKGROUND OF THE INVENTION

A typical forge manipulator has ingot tongs that grip the workpiece for forging and rotates it by means of a drive in a manner dependent on the forging process. Such a forging manipulator, particularly for multiple-hammer forging machines, is known from EP 0 434 891 B1. Here several hammers work on the forging piece radially, and the manipulator has a central rotatably mounted axle. The central axle moves the workpiece according to the forging sequence rotationally. A motor running with a predetermined constant rotation rate serves as the rotary drive of the manipulator. This motor is acts directly on the central axle of the manipulator via a worm drive. The rotational movement of the central axle stopped by the hammers before the pressure contact phase, and maintained stopped during the pressure contact phase. The worm driven in the process is mounted to be movable axially.

According to the prior art, the rotational movement of the forging piece is stopped before the pressure contact phase, i.e. engagement of the forging tool with the workpiece, and maintained stopped during the pressure contact phase.

Such rotary drives for manipulators of forging machines are nevertheless quite complex and expensive. In addition, owing to the complexity of the construction, the rotary drive is susceptible to malfunction.

OBJECTS OF THE INVENTION

It is therefore an object of the present invention to provide an improved manipulator for forging machine.

Another object is the provision of such an improved is manipulator for forging machine that overcomes the above-given disadvantages, in particular that is technically simpler and can be produced with less complexity, and also enables the main shaft of the manipulator at whose front end the ingot tongs are located to rotate precisely in defined angular steps such that the workpiece being forged receives a rectangular, square, polygonal or round profile. Despite this simplification, reliability should be increased.

SUMMARY OF THE INVENTION

A forging press has a workpiece manipulator having according to the invention a shaft centered on and rotatable about an axis, a grab for holding the workpiece in the press and rotationally fixed to the shaft, and a disk fixed angularly to the shaft and projecting radially outward therefrom. Two couplings are juxtaposed with the disk, rotatable relative to the shaft about the axis, and have respective clutches for locking onto the disk so that when locked onto the disk the couplings are rotationally fixed to the disk. Respective actuators connected to the couplings can angularly shift the disk and thereby rotate the shaft, the grab, and the workpiece held by the grab.

The rotary actuator that moves the grab, particularly ingot tongs, has a main shaft and the disk can be mounted in a conventional manner, for example by shrink fitting, welding, bolting, or a similar method on the shaft. Also according to the invention, the rotary actuator has a coupling mounted on the main shaft in a free floating manner and surrounding the coupling disk. It can be locked to the coupling disk, when required, for joint rotation of the coupling disk and the no longer free-floating coupler. Also, when the coupler is locked to the disk, movement of the coupler by its actuator(s) rotates the shaft and also the grab.

This configuration makes it possible that, when the grab is rotated in a desired manner at a predetermined angle about the longitudinal axis of the main shaft, and the coupler is engaged with the coupling disk, a rotational movement effected on the coupler by the coupling arrangement is entirely transmitted to the main shaft without any delay.

A preferred embodiment of the invention uses a hydraulic drive for the rotational movement of the main shaft about its longitudinal axis. The hydraulic drive very preferably has at least two hydraulic cylinders. Four hydraulic cylinders are provided in a more preferable configuration, connected at least indirectly to the main shaft. According to the invention, the indirect connection is implemented via the coupler and in a particularly preferable configuration, by the hydraulic drive, particularly the hydraulic cylinders, engaging with the free floating coupler.

According to one advantageous embodiment, the hydraulic cylinders can be positioned independently of each other, because this configuration supports, in a particularly advantageous manner, the degrees of freedom of the system and the possibilities associated with the hydraulically effected rotational movement of the grab main shaft. In an alternative embodiment of the invention, the hydraulic cylinders on one side of the shaft are synchronizing cylinders, in order to achieve an even application of the radial actuating force to each side of the main shaft via the cylinders.

In a particularly preferable configuration, the main shaft of the rotary actuator for the grab is designed as a tube shaft, thereby making it possible that the mass to be moved by the hydraulic drive can be optimally reduced without particularly influencing the rigidity and strength of the entire structure.

As already mentioned, the hydraulic cylinders engage with the couplers journaled on the shaft. This is particularly advantageously supported if there are at least two couplers flanking the coupling disk, whereby both a particularly secure construction of the overall coupling arrangement is achieved and also the possibility of having two actuators arranged on both sides of the main shaft for the rotational movement of the main shaft.

Particularly advantageously, the manipulator according to the invention can be part of a forging machine. In a most preferred embodiment of the invention, this forging machine is a so-called multiple-hammer forging machine.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
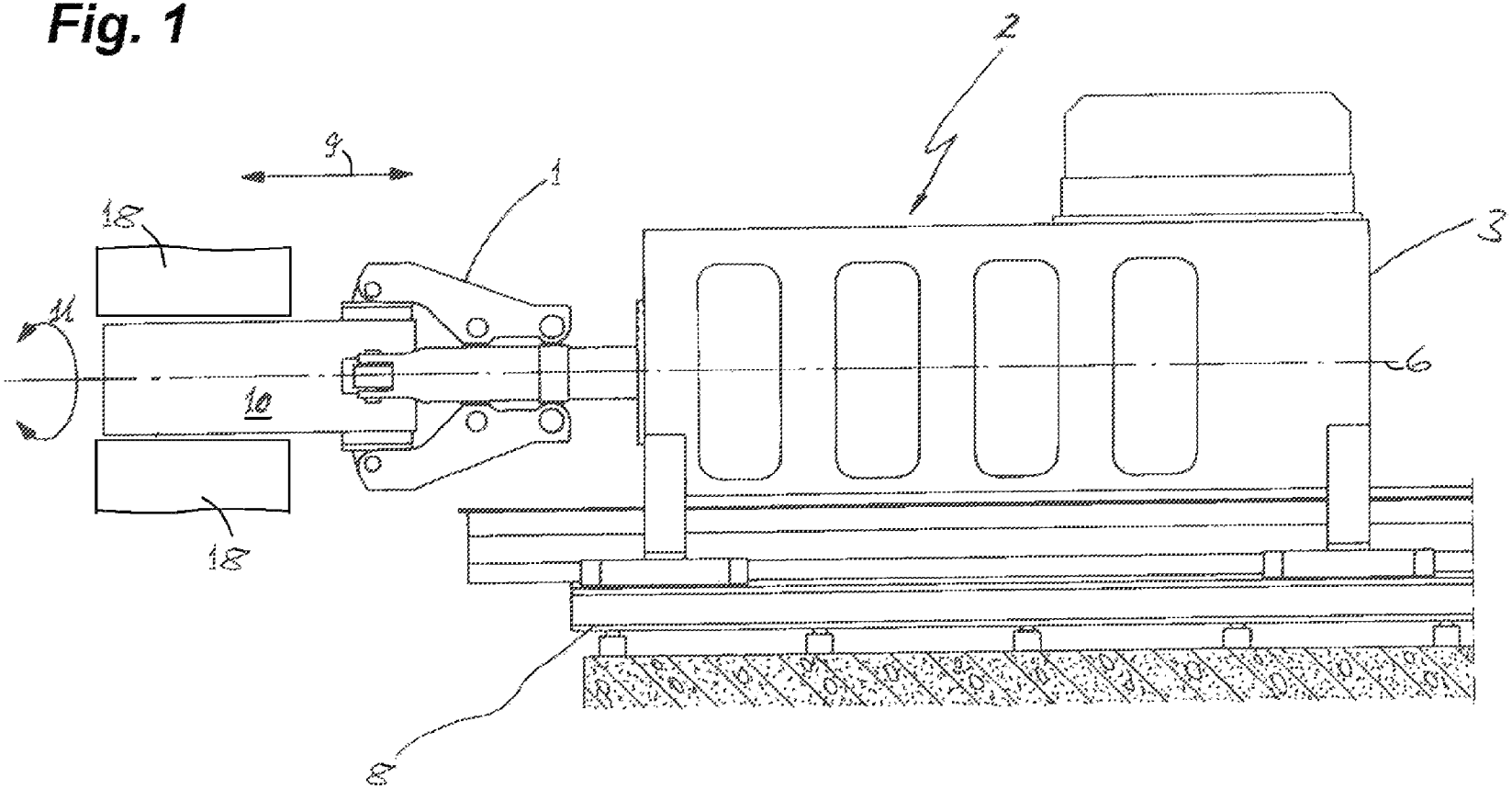
FIG. 1 is a side view of a forge manipulator and part of a forging machine according to the invention.

As seen in FIG. 1*a* manipulator 1 rides on a stationary guide bed 8 so as to be movable as shown by arrow 9 parallel to a longitudinal center axis 6. The manipulator has a main shaft 3 centered on the axis 6 and a grab 1 in the form of ingot tongs. A workpiece or ingot 10 to be forged can be shifted by the grab 6 both in the along the axis 6 as shown by the arrow 9 and also angularly as shown by arrow 11, such that it can be oriented as needed between the two forging tools or hammers 18 of an otherwise unillustrated forging machine.

Figure 2:
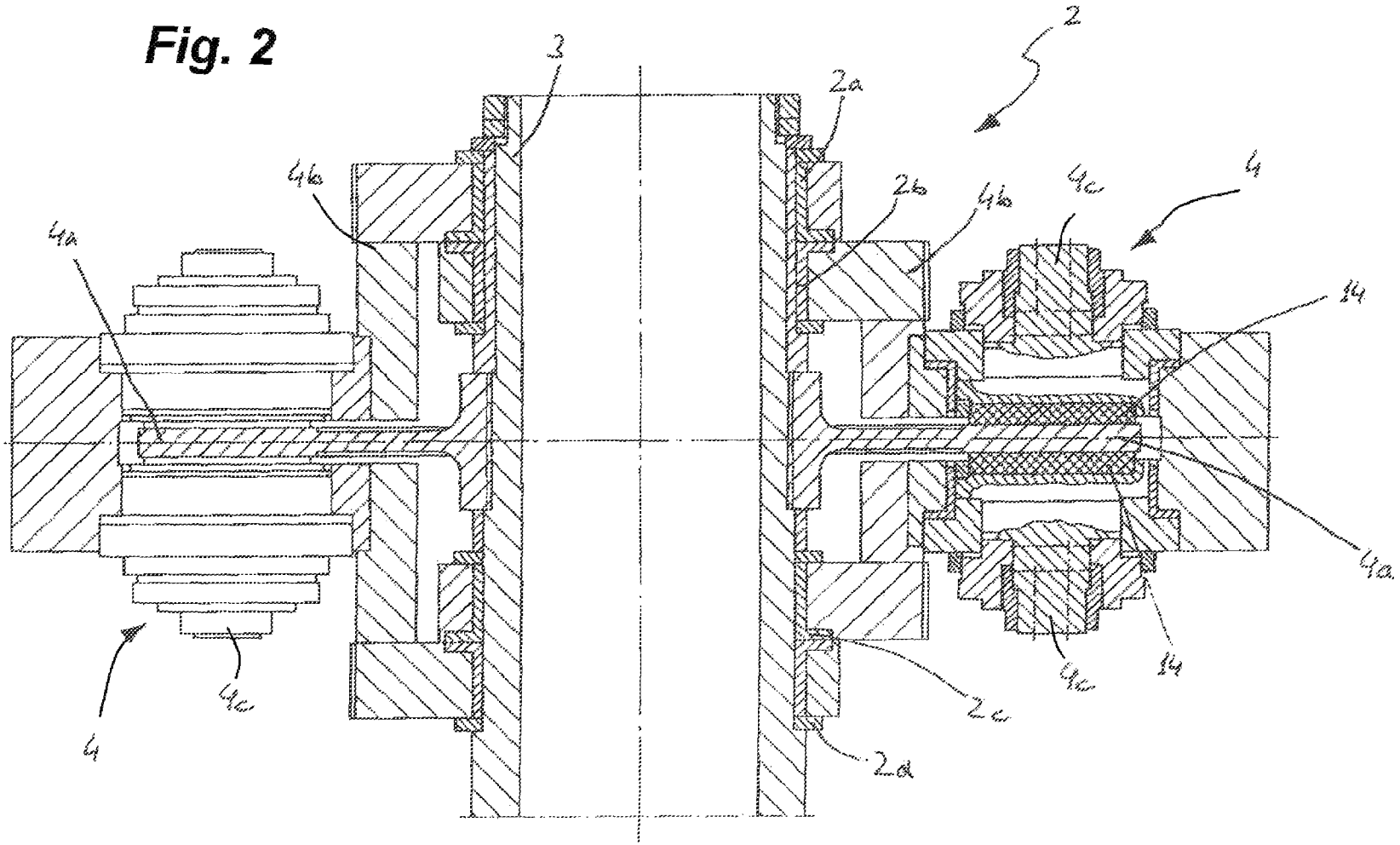
FIG. 2 is a large-scale axial section through part of the manipulator.
Figure 3A:
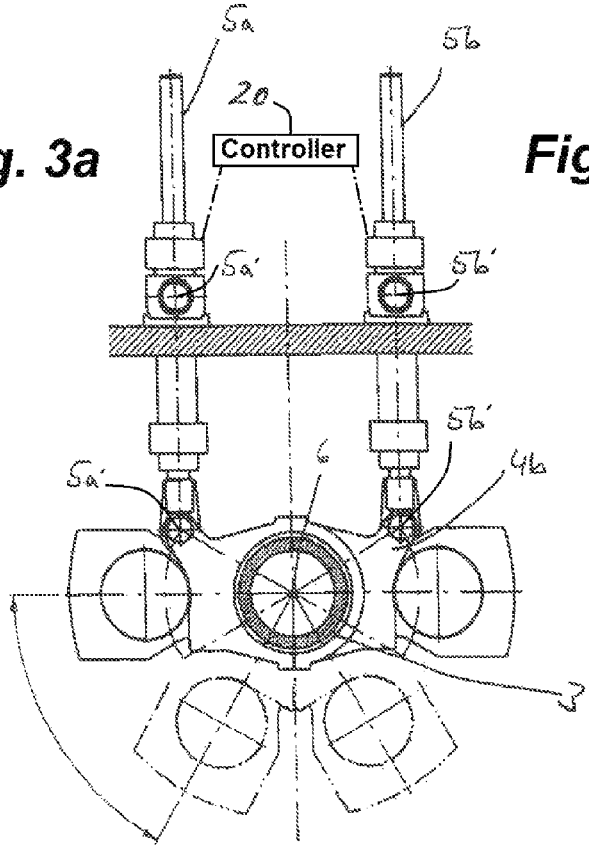
FIGS. 3*a* and 3*b* are small-scale end and sectional side views of the system of this invention.
Figure 3B:
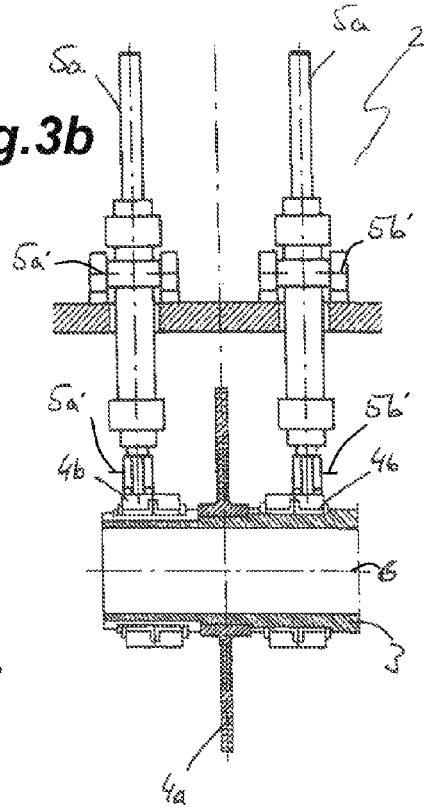

FIG. 2 shows a sectional view of the rotary actuator 2 for the partly shown tube shaft 3. A coupling disk 4*a* is shrunk-1ptofitted to the shaft 3 so as to be axially and angularly nondisplaceable fixed thereon. Two substantially identical couplings 4 each have a body 4*b* holding a pair of shoes 14 that can be pressed by respective hydraulic actuators 4*c* against respective axially opposite faces of the disk 4*a*. The bodies 4*b* of the couplings 4 annularly surround the shaft 3 and are supported by respective bearings 2*a*, 2*b*, 2*c*, and 2*d* thereon. When the shoes 14 are pressed by the respective actuators 4*c* against the disk 4*a*, the couplings 4 are locked rotationally to the disk 4*a* and through it to the shaft 3, and when they are retracted the shaft 3 is uncoupled, although normally one of the couplings 4 is locked to the disk 4*a* at any given time. Normally a controller 20 is responsible for such operation FIGS. 3*a* and 3*b* show how the actuator 2 has two pairs of hydraulic cylinders 5*a* and 5*b* pivoted about axes 5*a*' and 5*b*' above the shaft 3 on a fixed support 19 and that have piston rods pivoted at their lower ends on the respective coupling bodies 4*b* at axes 5*a*' and 5*b*'. The axes 5*a*' and 5*b*' are all parallel to one another and to the axis 6. FIG. 3*b* only shows the two axially spaced and ganged cylinders 5*a*. An even force application of the rotational movement of the main shaft 3 about its longitudinal axis is enabled by the use of synchronizing two cylinders 5*a* or 5*b* flanking the disk 4*a* on each of the coupling housings 4*b*. The cylinders 5*a* and 5*b* can rotate the shaft 3 through an angular movement that is a maximum of 60° in the illustrated embodiment.

Each of the cylinders 5*a* and 5*b* is a double-acting unit is with a piston rod projecting from each end so the opposite exposed piston faces are of identical surface area. This makes accurate bidirectional operation possible.

Figure 4A:
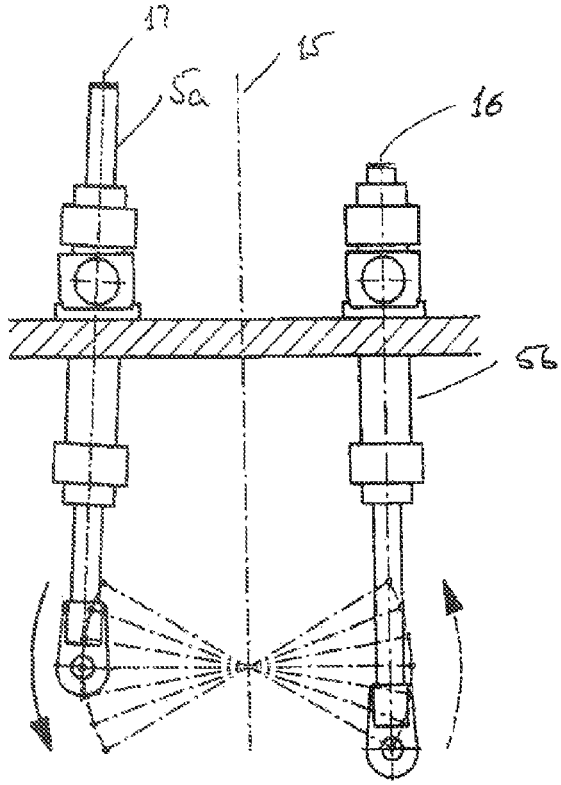
FIGS. 4*a* and 4*b* show pivoting operation of the system for forging a round, that is cylindrical workpiece.

FIG. 4 shows two steps in order to clarify the process of the rotary step control during forging of round rods, the two steps given in two drawings 4*a* and 4*b*, respectively. The left hydraulic cylinder 5*a* is in the actuating position, a deflection of its longitudinal axis 17 out of the vertical 15 resulting. The right cylinder 5*b*, in contrast, is shown in its starting position with its longitudinal axis 16 parallel to the vertical 15. Between the occurrence of two forging strokes, during which no rotational movement is applied by the rotary actuator to the grab (not pictured), steps occur in 10° increments. When one cylinder 5*a* or 5*b* reaches the end of its extension or contraction stroke, the shoes 14 of its coupling 4 are released and it is moved to its opposite end position, whereupon the shoes 14 again lock it to the disk 4*a* and the cycle can be restarted.

Figure 4B:
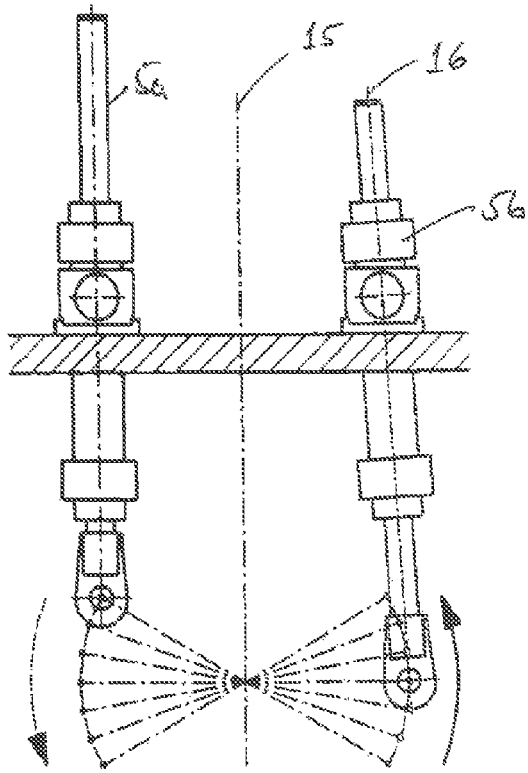

In contrast, in FIG. 4*b*, the left cylinder 5*a* is in its starting position, and the right cylinder 5*b* is in the actuating position with an angular offset of its longitudinal axis 16 from the vertical 15. According to the mode of operation made possible thereby, the right cylinder 5*b* moves after the final step of the left cylinder 5*a*, and after the final step of the right cylinder 5*b*, the actuation of the left cylinder 5*a* starts, the left cylinder being then once again in its starting position. In this way, the rotational movement of the grab (not pictured) and the forging piece (not pictured) is achieved by intermittent engagement of the hydraulic cylinders 5*a* and 5*b*.

Figure 5A:
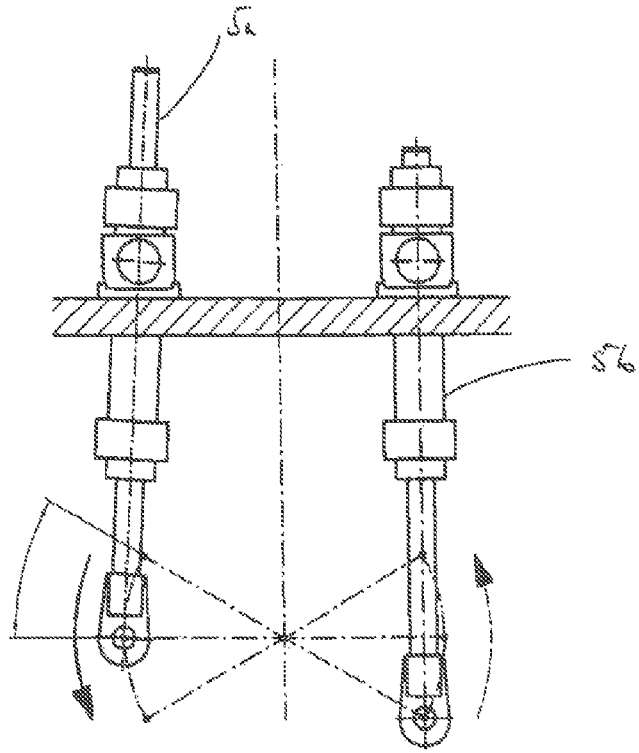
FIGS. 5*a* and 5*b* show the system forging a hexagonal-section workpiece.

Like FIGS. 4*a* and 4*b*, FIGS. 5*a* and 5*b* show an example the process of rotary step control, here for the forging of six-sided rods. In FIG. 5*a*, the left cylinder 5*a* is given in the actuating position, and the hydraulic cylinders 5*a* and 5*b* angularly move the workpiece through 30° steps between succeeding forging strokes. In the intermediate position illustrated in FIG. 5*a*, the right cylinder 5*b* is in its starting position.

Figure 5B:
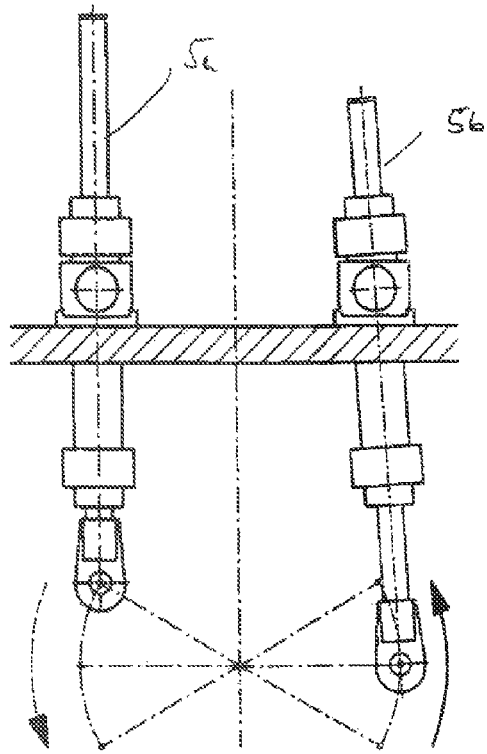

In contrast, in FIG. 5*b*, the left cylinder 5*a* is shown in the starting position and the right cylinder 5*b* in the actuating position. During operation, the right cylinder 5*b* moves after the last step of the left cylinder 5*a*, and after the last step of the right cylinder 5*b*, the left cylinder 5*a* is returned to the starting position from which it can resume angular stepping of the shaft 3.

Figure 6A:
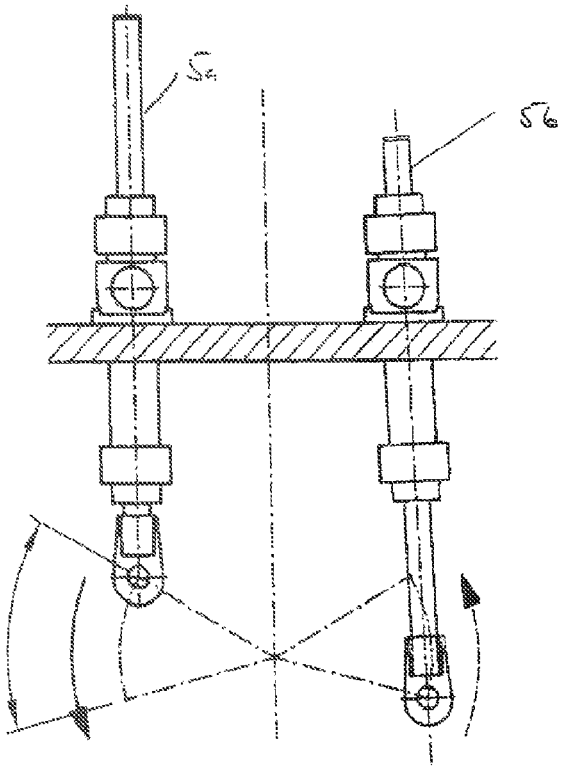
FIGS. 6*a* and 6*b* show the system forging a square or octagonal-section workpiece.
Figure 6B:
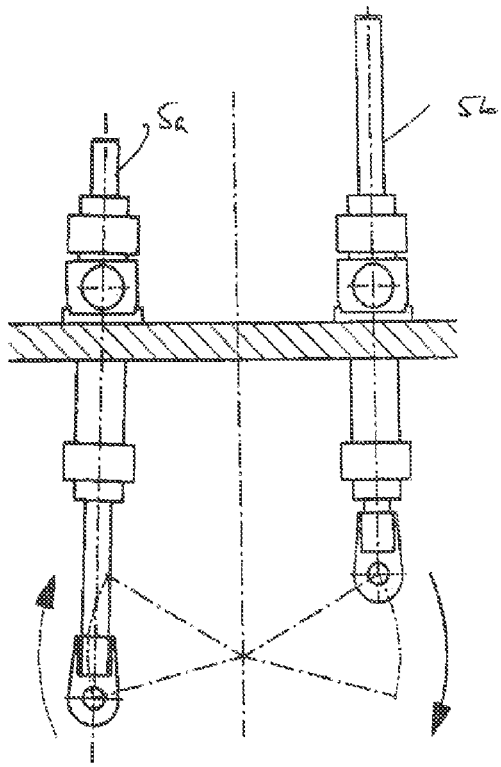

FIGS. 6*a* and 6*b* show rotary step control for forging a four- and/or eight-sided rod workpiece. In FIG. 6*a*, the left cylinder 5*a* is shown in the starting position while the right cylinder 5*b* is in the actuating position. During the forging of eight-sided rods, a 45° step is executed between two forging strokes. To forge four-sided rods, two 45° steps are carried out between two forging strokes, one immediately one after the other.

In contrast, in FIG. 6*b*, the left cylinder 5*a* is in an end position, and the right cylinder 5*b* is in a starting/actuating position. Consequently, the right cylinder 5*b* moves after stepping of the left cylinder 5*a*, and after the right cylinder 5*b* executes its step, the left cylinder 5*a* starts from the starting position to which it has by then returned.

I claim:

1. In combination with a forging press, a workpiece manipulator comprising:

a shaft centered on and rotatable about an axis;

a grab for holding the workpiece in the press and rotationally fixed to the shaft;

a disk fixed angularly to the shaft and projecting radially outward therefrom;

two couplings juxtaposed with the disk, rotatable relative to the shaft about the axis and having respective means for locking onto the disk, whereby when locked onto the disk the couplings are rotationally fixed to the disk; and respective actuators connected to the couplings for angularly shifting same and thereby rotating the shaft, the grab, and the workpiece held by the grab.

2. The combination defined in claim 1 wherein the grab is tongs.

3. The combination defined in claim 1 wherein the actuators are hydraulic.

4. The combination defined in claim 3 wherein the cylinders are double acting.

5. The combination defined in claim 3, further comprising control means for independently operating the actuators and the means for locking.

6. The combination defined in claim 5 wherein the control means operates the actuators intermittently and holds at least one of the couplings locked to the disk at any given time.

7. The combination defined in claim 3 wherein each coupling has a housing journaled on the shaft adjacent the disk and pivoted to the respective actuator.

8. The combination defined in claim 7 wherein two such actuators axially flanking the disk are provided for each coupling housing.

9. The combination defined in claim 3 wherein each actuator is pivoted at an outer end on a fixed support and at an inner end on the respective coupling.

10. The combination defined in claim 9 wherein the outer and inner ends of the couplings are pivoted about axes parallel to the axis of the shaft.

11. The combination defined in claim 1 wherein the forging press is a multiple-hammer forging machine.

* * * * *